United States Patent [19]

Hsu

[11] 4,196,662

[45] Apr. 8, 1980

[54] CONTINUOUS FEED HOT LEAF IMPRINTER

[75] Inventor: Wei K. Hsu, East Rutherford, N.J.

[73] Assignee: Adolph Gottscho, Inc., Union, N.J.

[21] Appl. No.: 885,418

[22] Filed: Mar. 10, 1978

[51] Int. Cl.[2] ..... B65H 19/16

[52] U.S. Cl. ..... 101/27; 101/DIG. 4; 242/58.4; 242/58.5

[58] Field of Search ..... 101/288, 24, 27, DIG. 4; 242/58, 58.1, 58.4, 58.5

[56] References Cited

U.S. PATENT DOCUMENTS

| | | | |
|---|---|---|---|
| 2,772,055 | 11/1956 | Klingelfuss | 242/58.4 |
| 2,940,507 | 6/1960 | Butler | 242/58.4 X |
| 3,035,787 | 5/1962 | Kihachiro et al. | 242/58.4 |
| 3,495,783 | 2/1970 | Headington et al. | 242/58.4 |
| 3,774,529 | 11/1973 | Filsinger et al. | 107/DIG. 4 |
| 3,925,131 | 12/1975 | Krause | 242/58.3 X |
| 3,939,031 | 2/1976 | Takimoto | 242/58.4 X |
| 4,010,911 | 3/1977 | Heitmann | 242/58.4 |
| 4,044,676 | 8/1977 | Hudson | 101/27 X |

*Primary Examiner*—Edward M. Coven
*Attorney, Agent, or Firm*—Blum, Kaplan, Friedman, Silberman & Beran

[57] ABSTRACT

A hot leaf imprinter is provided with first and second hot leaf supply rolls and a guide arrangement for guiding the hot leaf from said first and second supply rolls along first and second paths to a printing station. The respective portions of said first and second paths adjacent said printing station correspond with each other, the first and second paths being aligned in spaced relation at a portion thereof immediately in advance of the corresponding portion with the respective hot leaf from said first and second supply rolls in facing spaced relation. A selectively actuable plunger is provided for normally holding the beginning of the hot leaf of one of said first and second supply rolls in spaced relation to the hot leaf of the other of said first and second supply rolls and for selectively displacing said beginning of the hot leaf of said one of said first and second supply rolls into secured engagement with the hot leaf of the other of said first and second supply rolls. Means may be provided for detecting the end of the hot leaf of said other of said first and second supply rolls in its path for actuating the plunger so that the beginning of the hot leaf of one supply roll is automatically spliced to the end of the hot leaf of the other supply roll to provide continuous feed of hot leaf to the printing station.

15 Claims, 17 Drawing Figures

TO PRINTING STATION 10

FIG. 9
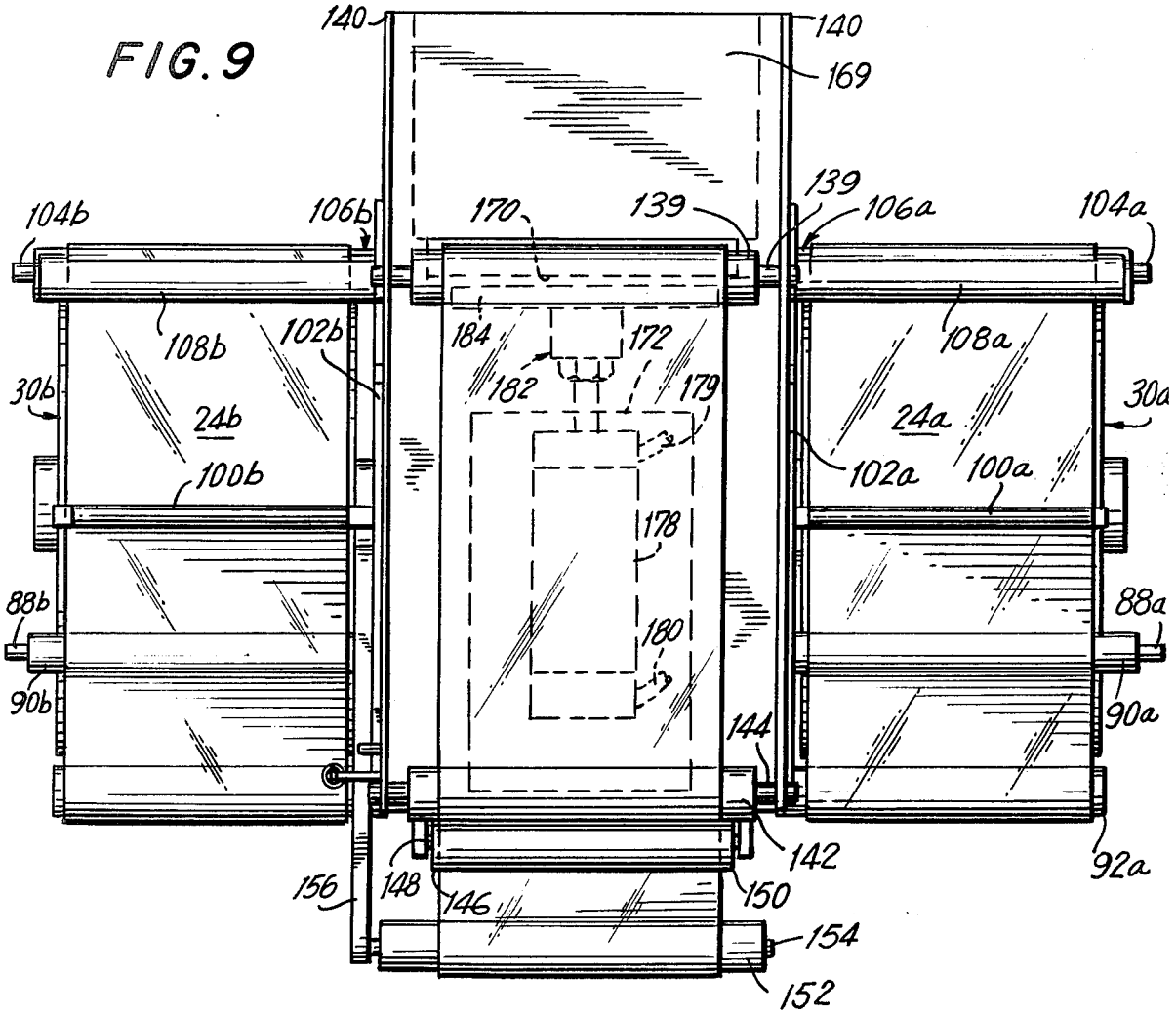
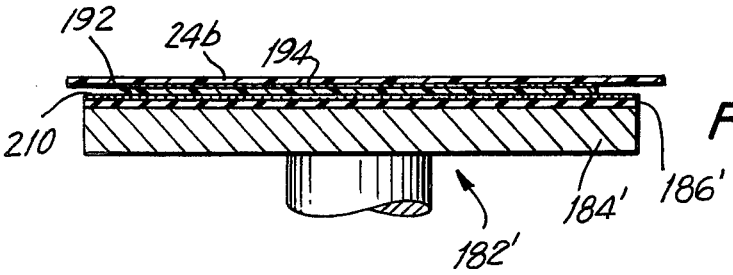
FIG. 10
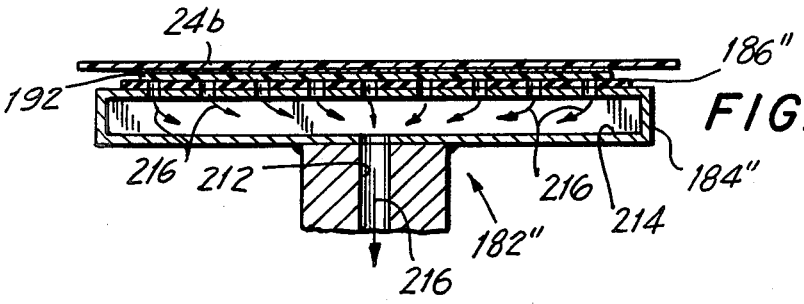
FIG. 11

FIG. 12
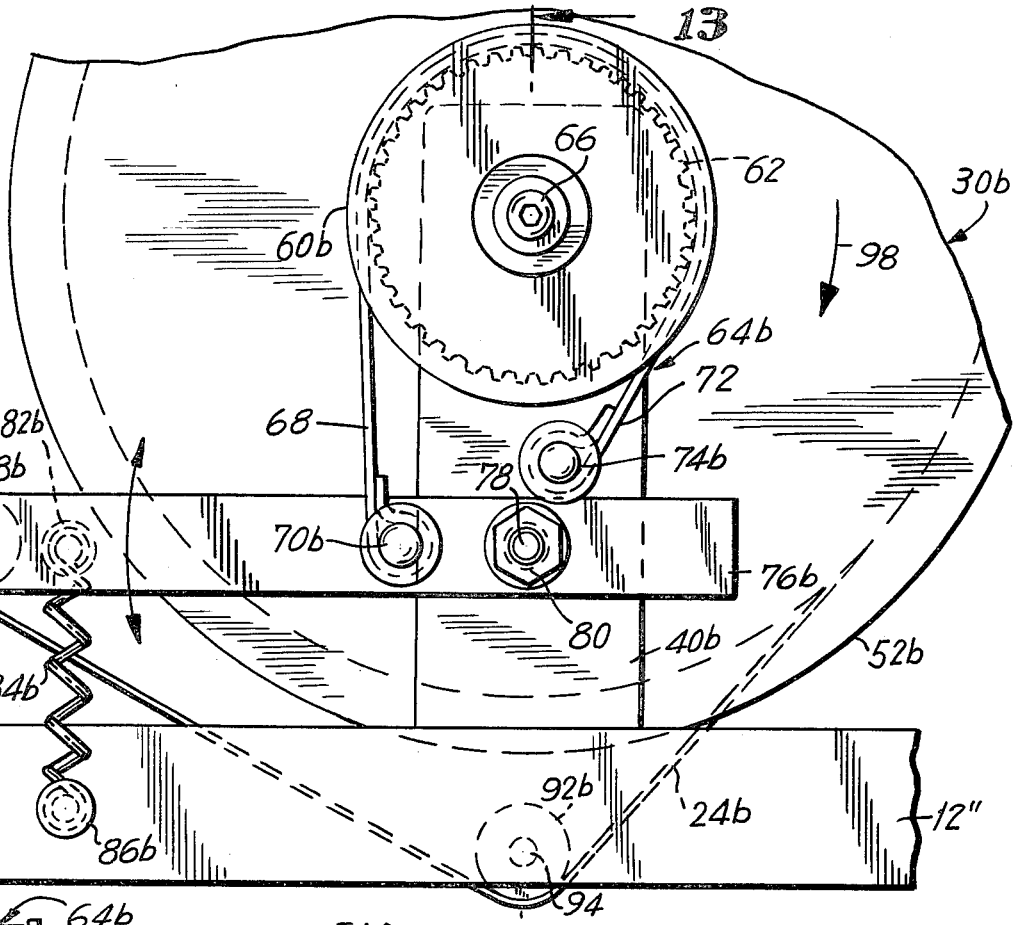
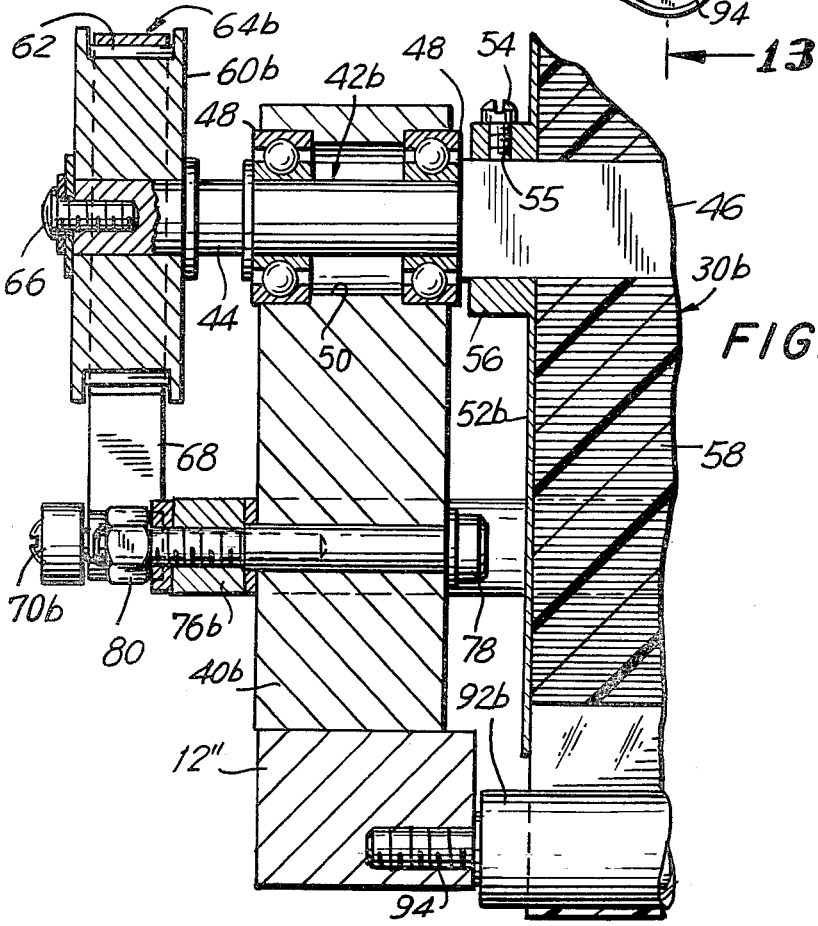
FIG. 13

14'
220a
222a
108a'
106a'
53a
30a
54
56
88a
90a
46
42a
52a
116'
256
156'
12'
162'
150'
102a'
40a
74a
76a
160
164'
112a'
168'
146'
64b
64a
60b
60a
72
68
70b
114'
152'
102b'
112'
40b
74b
76b
222b
52b
44
148'
42
106b'
108b'
53b
30b
224
106b''
88b

CONTINUOUS FEED HOT LEAF IMPRINTER

BACKGROUND OF THE INVENTION

This invention relates to improvements in printing or marking apparatus, particularly of the type in which a hot leaf is pressed by a heated die or printing block against a web or sheet of sheet material so as to transfer pigment from the hot leaf to the sheet material and thereby form the desired marking or imprint on the latter. Hot leaf is generally provided in the form of a roll of a carrier bearing the pigment.

Apparatus of the type described in frequently employed for marking a web of sheet material being advanced intermittently to a wrapping or other machine which utilizes the marked web, and in that case, it is necessary to synchronize the operation of the marking apparatus with the intermittent advance of the web by the associated machine so that the heated die presses the hot leaf against the web only when the web is at rest. Further in such marking apparatus, it is desirable to feed the hot leaf after each marking operation so as to expose a fresh or unused section thereof to the action of the heated die during the next marking operation. Although marking apparatus presently exists for performing the foregoing operation, one disadvantage of such apparatus is that when the roll of hot leaf is exhausted, it is necessary to stop the imprinting device and the wrapping or other associated machine to permit replacing of the hot leaf supply roll. Such down time increases the expense of the wrapping or packaging operation of which the hot leaf imprinter is but one component.

By providing an arrangement which continuously feeds hot leaf from successive supply rolls to the printing station without the necessity of stopping the operation of the imprinter, the foregoing defects in the known imprinters are avoided.

SUMMARY OF THE INVENTION

Generally speaking, in accordance with the invention, a continuous feed hot leaf imprinter is provided including a printing station, means for supporting first and second hot leaf supply rolls, guide means defining first and second guide paths between said first and second supply roll supports and said printing station, said guide means being adapted so that the respective portions of said first and second paths adjacent said printing station correspond with each other and so that the portions of said first and second paths adjacent said corresponding portions are in spaced alignment so that hot leafs therein would be in spaced facing relation, means for holding the beginning of a roll of hot leaf in the aligned portion of one of said paths and means for selectively displacing said retained beginning of a hot leaf roll into secured relation with the facing portion of the hot leaf of the other roll, whereby the advancing of the hot leaf of the other roll through the corresponding portion of said path advances the hot leaf of said one roll therewith.

Means may be provided for detecting the end of the hot leaf of said other roll and actuating said displacing means in response to such detection for splicing the beginning of said one roll to substantially the end of said other roll. The beginning of said one roll may be retained on the end of a plunger means adapted for selective displacement between said first and second paths. Back-up plate means may be provided for supporting the hot leaf of said other roll during said securing displacement. Adhesive means may be applied to the beginning of the hot leaf of said one roll to effect the securing thereof to the hot leaf of said other roll. Said guide means is adapted so that each of said guide paths includes a portion intermediate said supply roll support means and said aligned regions wherein the respective guide paths are in substantially side-by-side alignment so that the hot leaf therein are out of overlapping relation and a coupling portion between said side-by-side portion and said aligned portion. The coupling portion of each of said first and second guide means may be formed by first and second guide plates shaped so that one side thereof are in substantially side-by-side relation and the other side thereof are in substantially spaced overlapping relation. The imprinter in accordance with the invention includes a frame, said first and second guide plates being mounted for pivotable and lateral displacement on said frame so that the relative positions of the overlapped ends of said guide plates may be switched.

Accordingly, it is an object of this invention to provide an imprinter in which hot leaf may be continuously fed.

Another object of the invention is to provide a hot leaf imprinter wherein an exhausted roll of hot leaf may be replaced while hot leaf is continuously fed to the printing station of the imprinter from a second roll.

A further object of the invention is to provide a device for splicing the beginning of one roll of a tape material to the end of another roll of tape material in an automatic fashion during the incremental intermittent advance of the tape of said other roll of tape material.

Still other objects and advantages of the invention will in part be obvious and will in part be apparent from the specification and drawings.

The invention accordingly comprises the features of constructions of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 9 is an end elevational view taken along lines 9—9 of FIG. 2;

FIGS. 10 and 11 are fragmentary sectional views showing alternate embodiments of the plunger in accordance with the invention;

FIG. 12 is an enlarged fragmentary sectional view taken along lines 12—12 of FIG. 3;

FIG. 13 is a fragmentary sectional view taken along lines 13—13 of FIG. 12;

DESCRIPTION OF THE PREFERRED EMBODIMENTS

Figures 1, 2:
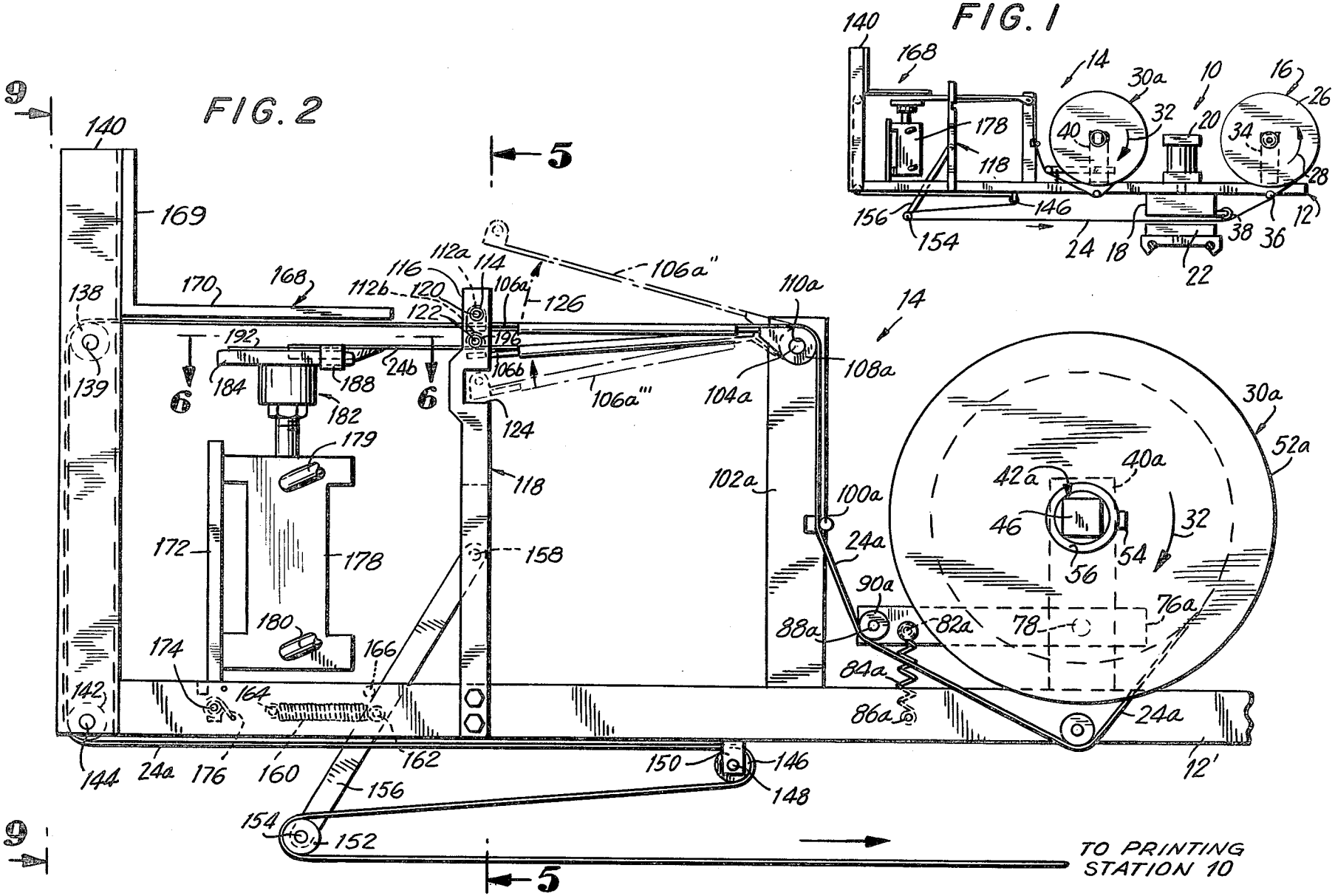
FIG. 1 is a partially schematic side elevational view of one embodiment of an imprinter in accordance with the invention.
FIG. 2 is an enlarged side elevational view of the hot leaf feed arrangement of the imprinter of FIG. 1.

Referring to FIG. 1, the imprinter depicted includes a printing station shown generally at 10, a main frame 12 supporting at least a part of said printing station, a hot leaf feed arrangement shown generally at 14 and a take-up arrangement shown generally at 16. Printing station 10, shown schematically in FIG. 1 may be of conventional design and would include a heated die 18 displaceable in the vertical direction as viewed in FIG. 1, as by cylinder 20. Heated die 18 would include an indicia to be imprinted. The printing station includes a back-up plate 22, hot leaf 24 extending between hot leaf feed arrangement 14 and take-up arrangement 16 in the space between heated die 18 and back-up plate 22. A web of material to be imprinted (not shown) would be incrementally advanced in the space between hot leaf 24 and back-up plate 22. Between incremental advances of said web, cylinder 20 would be actuated to displace heated die 18 against back-up plate 22 with hot leaf 24 and said web therebetween to effect imprinting on said web, heated die 18 returning to its rest position as shown after a predetermined period of engagement with the back-up plate. Thereafter, a drive mechanism (not shown) would cause back-up roller 26 of back-up arrangement 16 to rotate in the direction of arrow 28 to incrementally advance hot leaf 24 to present an un-used portion thereof in registration with the indicia on heated die 18. As will be more particularly described below, the hot leaf 24 is drawn along a circuitous path defined by the hot leaf feed arrangement from first supply roll 30*a* which rotates in the direction of arrow 32.

Referring to the take-up arrangement 16, said arrangement includes a support 34 rotatably supporting take-up roller 26 and guide rollers 36 and 38 mounted, respectively, on frame 12 and heated die 18. The printing station 10 and take-up arrangement 16 of FIG. 1 are of conventional design and require no further description herein.

Figure 3:
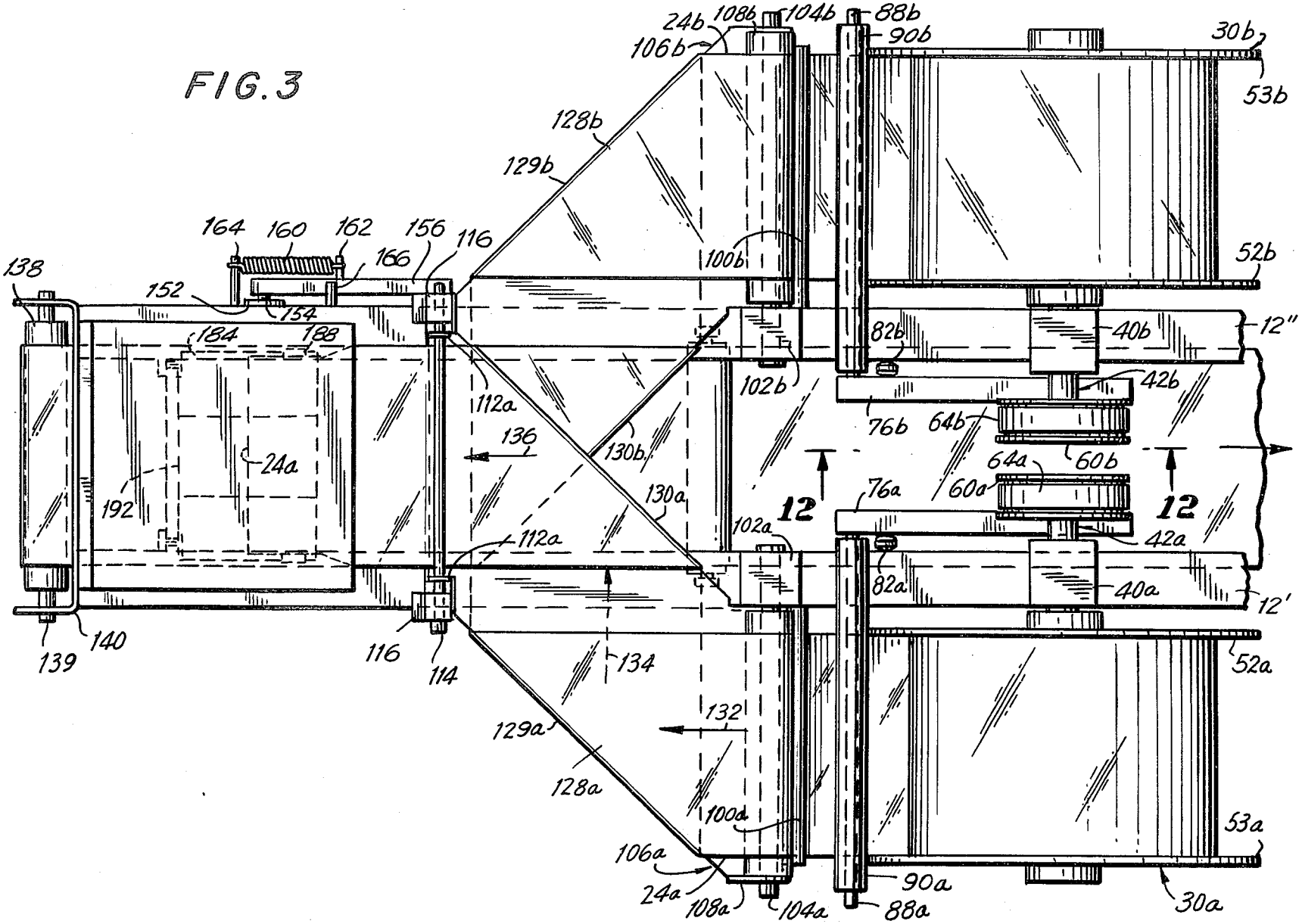
FIG. 3 is a top plan view of the imprinter of FIG. 2.

Turning to FIGS. 2 through 13, the hot leaf feed arrangement 14 depicted therein is supported on frame 12, and more specifically, on a pair of spaced frame beams 12′ and 12″. Extended upwardly from each frame beam is a supply roll support 40*a* and 40*b* for respectively supporting first supply roll 30*a* and second supply roll 30*b*. Referring to FIGS. 12 and 13, the braking and support arrangement for supply roll 30*b* will be described, a like arrangement being provided in connection with supply roll 30*a*, corresponding reference numerals being applied to like elements. A shaft 42*b* is provided with a first portion 44 of circular cross-section and a second portion 46 of square cross-section. The circular cross-sectioned portion 44 of shaft 42*a* is journaled through bearings 48 mounted in a bore in an upper region of supply roll support 40*b*. A pair of spool plates 52*b* and 53*b* are mounted to the square cross-sectioned portion 46 of shaft 42*b*, as by set screw 54 in threaded bore 55 of hub portion 56 as illustrated in FIG. 13. Shaft portion 46 and spool plates 52*b* and 53*b* together define supply roll 30*b*. A spool of hot leaf 58 may be mounted on shaft portion 46 by merely removing spool plate 53*b*, the spacing between spool plates 52*b* and 53*b* being selected in relation to the width of the hot leaf in said spool. The circular cross-sectioned portion 44 of shaft 42*b* projects beyond supply roll support 40*b* and supports a brake roller 60*b*. The periphery of brake roller 60*b* is formed with a toothed channel 62 which receives a brake belt 64*b*. Brake roller 60*b* is secured to shaft 42*b* by bolt 66 as shown in FIGS. 12 and 13. One end 72 of brake belt 64*b* is secured around post 74*b*, which post projects from and is secured to supply roll support 40*b*. The other end 68 of brake belt 64*b* extends around and is secured to a post 72*b* mounted on one end pivot bar 76*b*. Pivot bar 76*b* is itself pivotably mounted to supply roll support 40*b* by means of bolt 78 and nut 80. Post 74*b* is positioned on and spaced from of the pivot point of pivot bar 76*b* as defined by bolt 78. Mounted on the same side of said pivot point near the end of pivot bar 76*b* is a post 82*b* securing one end of coil spring 84*b*, the other side of said coil spring being secured to a post 86*b* mounted on frame beam 12″. Also mounted on pivot bar 70*b* adjacent post 82*b* is post 88*b* which rotatably supports guide roller 90*b*. The hot leaf from supply roll 30*b* is guided around a guide roller 92*b* rotatably mounted on post 94, which is in turn secured to frame beam 12″ immediately below supply roll support 40*b*. From guide roller 92*b* the hot leaf 24*b* engages the under side of guide roller 90*b* so that when hot leaf 24*b* is pulled by the take-up assembly 16 in the direction of arrow 96 of FIG. 12, supply roll 30*b* rotates in the direction of arrow 98 of FIG. 12. Simultaneously, the braking force on the supply roll is released by the pivoting of pivot bar 76*b*. When the advance ceases, pivot bar 76*b* is released and the braking force is applied to brake roller 60*b* by brake belt 64*b*, due to the force of spring 84*b*. This braking arrangement prevents over-feeding of the hot leaf. Referring to FIGS. 2,3 and 9, it is seen that hot leaf 24*a* and hot leaf 24*b* are respectively guided from the associated guide rollers 90*a* and 90*b* past guide rollers 100*a* and 100*b* respectively, guide rollers 100*a* and 100*b* being respectively rotatably mounted in a central region of guide plate supports 102*a* and 102*b*, respectively, said guide plate supports being respectively mounted on frame beams 12′ and 12″. Extending laterally outwardly from the upper region of each of guide plate supports 102*a* and 102*b* is a pin 104*a* and 104*b* respectively. Each of pins 104*a* and 104*b* supports a guide plate 106*a* and 106*b* respectively. Referring to guide plate 106*a*, the guide plate includes a curved guide portion 108*a* which serves both to mount that end of guide plate 106*a* to pin 104*a* and further serves as a curved guide for the passage of hot leaf 24*a* from the substantially vertical to the substantially horizontal portion of its path as illustrated in FIG. 2. For purposes more particularly described below, the bore 110*a* in curved portion 108*a* of guide plate 106*a* permits both the pivoting and lateral displacement of guide plate 106*a* relative to pin 104*a*. Guide plate 106*a* is provided with a pair of upwardly projecting tabs 112*a* formed with apertures therethrough for receiving a rod 114. Rod 114 is supported at its ends by a pair of upwardly projecting arms 116 of further guide plate support 118 (FIG. 5), said further guide plate support 118 being secured to and bridging in its lower portion frame beams 12 and 12' as more particularly shown in FIG. 5.

Figure 5:
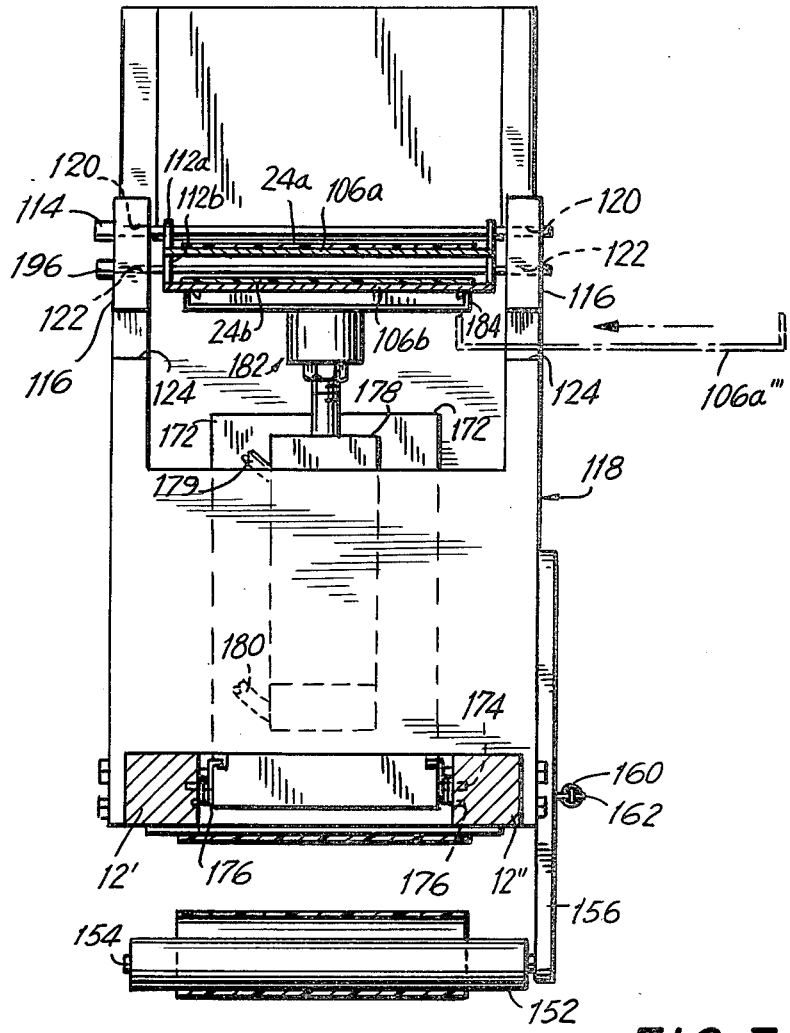
FIGS. 5 and 6 are sectional views taken along lines 5—5 and 6—6 of FIG. 2 respectively.

Each arm 116 is formed with a pair of longitudinally spaced, laterally extending bores 120 and 122 (FIGS. 2 and 5). Each of said arms is also formed with a notch 124 on the side thereof facing guide plates supports 102*a* and 102*b* in the region immediately below bores 120 and 122. Rod 114 is removably mounted in bores 120 an may be laterally displaced to free the end of guide plate 106*a* secured thereby for pivotable displacement in the direction of arrow 126 in FIG. 2 as will be described below. As more particularly shown in FIG. 3, guide plate 106*a* is provided with a central portion 128*a* in the shape of a parallelogram with inclined edges 129*a* and 130*a* extending substantially parallel to each other and bridging the end sections of the guide plate supporting rounded portion 108*a* and tabs 112*a*. As noted above, web 24*a* passes from guide roller 100 around rounded portion 108*a* and across the top surface of guide roller 106*a* as viewed in FIG. 3 in the direction of arrow 132 and thereafter extends around edge 129*a*. Hot leaf 24*a* then passes across the bottom surface of the parallelogram-shaped central portion 128*a* of guide plate 106*a* in the direction of arrow 134 of FIG. 3 and extends around edge 130*a* back to the top surface of guide plate 106*a*. The web extends across said top surface in the direction of arrow 136 of FIG. 3 and extends between tabs 112*a* to guide roller 138 rotatably mounted on axle 139 which is in turn mounted on U-shaped back-up support 140. Back-up support 140 is secured to the extreme ends of frame beams 12' and 12" and extends upwardly therefrom as viewed in FIG. 2. Guide roller 138 is mounted so that hot leaf 24*a* extends substantially horizontally between the top surface of guide plate 106*a* as positioned in FIG. 2 and said guide roller 138. Still another guide roller 142 is mounted at the bottom of back-up support 140 by means of axle 144 and positioned to permit hot leaf 24*a* to pass therearound and to extend beneath and substantially parallel to frame beams 12' and 12" to guide roller 146 mounted by axle 148 to tabs 150 depending from frame beams 12' and 12". Hot leaf 24*a* extends around guide roller 146 to a tensioning roller 152 which is mounted by means of axle 154 on an arm 156 which is pivotably mounted on one of further guide plate supports 18 by means of a pin 158 (FIG. 2). Arm 156 is biased in the clockwise direction about the axis defined by pin 158 as viewed in FIG. 2 by a spring 160 extending between pin 162 mounted on arm 156 and pin 164 mounted on frame beam 12'. Such clockwise displacement is limited by a further pin 166 projecting from frame beam 12'.

Figure 6:
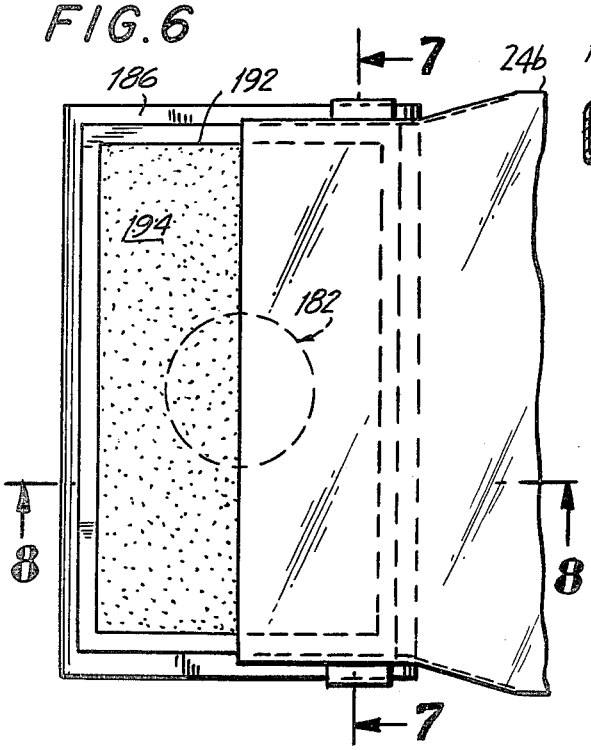
Figure 7:
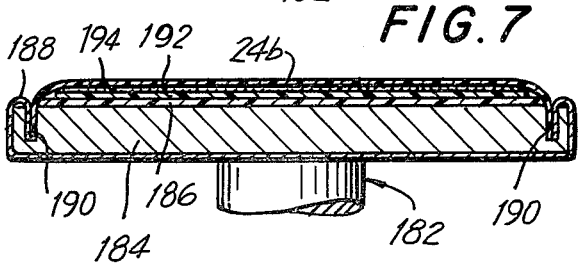
FIGS. 7 and 8 are sectional views taken along lines 7—7 and 8—8 of FIG. 6 respectively.
Figure 8:
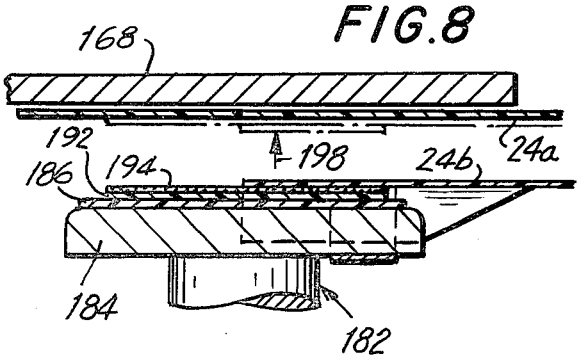

L-shaped back-up plate member 168 is secured by leg 169 thereof to back-up support 140 so that back-up leg 170 projects across and above the path of hot leaf 24*a* further guide plate support 118 and guide roller 138. A plunger support plate 172 is pivotably mounted by means of axle 174 between frame beams 12' and 12" and is retained in a normally vertical position by means of a pair of torsion springs 176. Air cylinder 178 is mounted to plunger support plate 172 and is provided with a pair of control tubes 179 and 180 which control the displacement of plunger 182 operatively mounted in air cylinder 178. Plunger 182 is provided, at the end thereof, with a plunger plate 184 of substantially rectangular cross-section and supporting a flat plunger pad 186, preferably formed of a resilient material. As more particularly shown in FIGS. 6 and 7, a metal spring clip 188 extends around the underside of plunger plate 184 and into a pair of slots 190 formed in the top surface of plunger plate 184 on opposed sides of plunger pad 186. The beginning of hot leaf 24*b* from supply roll 30*b* is retained on plunger plate 184 by passing the side edges thereof into slots 190 for retention therein by spring clip 188 as shown in FIGS. 6 and 7. Secured to the underside of the beginning of hot leaf 24*b* is a rectangular piece of adhesive tape 192 having adhesive 194 only on one surface thereof. One-half of the tape is engaged against and adhered to the underside of hot leaf 24*b* while the other half rests on plunger pad 186 with the adhesive 194 thereof exposed. Hot leaf 24*b* extends from the end of guide plate 106*b* defined by taps 112*b*.

Guide plate 106*b* is formed in the same shape as guide plate 106*a* except that the central parallelogram portion thereof is inclined in the opposite direction as shown in FIG. 3. Like reference numerals have been applied to guide plates 106*a* and 106*b* and the supports therefor. As in the case of hot leaf 24*a*, hot leaf 24*b* extends from supply roll 30*b* about guide roller 92*b*, thence to guide roller 90*b*, thence to guide roller 100*b* and thence about curved portion 108*b* of guide roller 106*b*. Web 24*b* extends across the top surface of guide member 106*b* to edge 129*b*. Hot leaf 24*b* extends about edge 129*b*, across the bottom surface of the central parallelogram-shaped portion 128*b* of guide member 106*b*, about edge 130*b* and thence across the top surface of guide plate 106*b* between tabs 112*b*, and thence to plunger plate 184.

Hot leafs 24*a* and 24*b* extend along respective paths the first portion of each of which extends side-by-side and is represented by the respective guide rollers 92*a* and 92*b*, 90*a* and 90*b* and 100*a* and 100*b*. On the other hand, in the region between plunger plate 184 and further guide plate supports 118 the paths of hot leafs 24*a* and 24*b* are aligned but in spaced relation so that the respective hot leafs are positioned in facing spaced relation as illustrated in FIG. 2. Guide plates 106*a* and 106*b* serve to define a coupling region of the paths of the respective hot leafs wherein the hot leafs are guided from a position on the outside of frame 12 to a position intermediate the frame beams thereof as illustrated in FIG. 3.

As shown in FIGS. 2 and 5, the side of guide plate 106*b* including tabs 112*b* is supported below the corresponding side of guide plate 106*a* by a rod 196 which is supported in bores 122 of arms 116 of further guide plate support 118 and extends through the apertures in tabs 112*b*.

In the orientation depicted in FIGS. 2 and 3, hot leaf 24*a* is being fed to printing station 10. The hot leaf feed arrangement 14 would be provided with a detector (not shown in this embodiment) for detecting the end of hot leaf 24*a* and in response to such detection, plunger 182 is actuated by air cylinder 178 to displace said plunger in the upward direction as viewed in FIG. 2 (in the direction of arrow 198 in FIG. 8) to engage the exposed portion of adhesive tape 192 against the under surface of hot leaf 24*a* so as to splice the beginning of hot leaf 24*b* to the end region of hot leaf 24*a*. Spring clip 188 has a sufficiently weak hold on hot leaf 24*b* to permit the release thereof from the spring clip upon the retraction of the plunger 182. Thereafter, hot leaf 24*b* is incrementally advanced by the tension applied by take-up roller arrangement 16 to perform the imprinting function. Once hot leaf 24*b* is spliced to hot leaf 24*a*, the path thereof corresponds to the prior path of hot leaf 24*a* and in fact, at least a small length of the two hot leafs overlap and pass through the printing station together.

It is now necessary to reset take-up roller arrangement 16 for the automatic splicing of a new hot leaf upon the exhaustion of the spool of hot leaf on supply roll 30*b*. This is accomplished, without interrupting the operation of printing station 10 or of the associated machinery by first removing pin 114 and pivoting guide plate 106*a* in the direction of arrow 126 as shown by chain lines 106*a*'' in FIG. 2. When so pivoted, guide plate 106*a* may be laterally displaced on pin 104*a* to a position where it clears further guide plate support 118 and may be pivoted in the direction opposite to arrow 126 to a position in registration with notch 124 as shown by chain lines 106*a*'' and 106*a*'''. At this position, guide plate 106*a* may be laterally displaced back to its original position on post 104*a*, but the side thereof defined by tabs 112*a* is now below the corresponding side of guide plate 106*a*. Rod 196 is then removed, and guide plate 106*b*, supporting hot leaf 24*b* is pivoted, in the direction of arrow 126 of FIG. 2 the small distance between bores 122 and 120 and held in alignment with bores 120 by the reinsertion of rod 114. A new spool of hot leaf is mounted on supply roll 30*a*, and guided along the path described about in connection with hot leaf 24*b* but around the repositioned guide plate 106*a* which would be retained in position by rod 196, only in the position illustrated in FIG. 2 for guide plate 106*b*. In other words, guide plates 106*a* and 106*b* are reversed in their relative positions. The beginning of the new spool of hot leaf guided around repositioned guide plate 106*a* is secured to plunger plate 184 in the manner described above together with a fresh piece of adhesive tape 192, so that the hot leaf feed arrangement is oriented for the splicing of a new hot leaf upon the exhaustion of hot leaf 24*b*.

Figure 4:
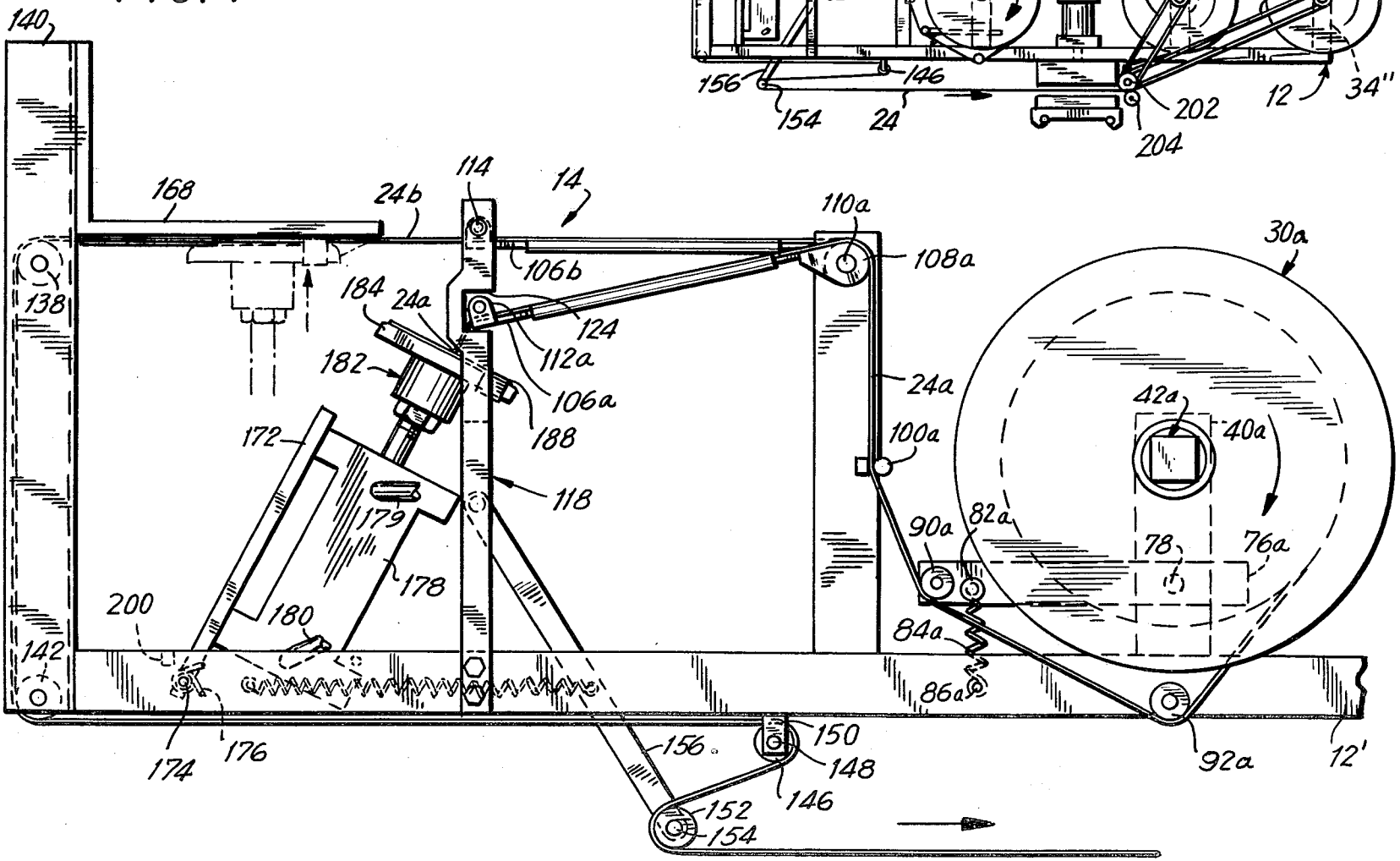
FIG. 4 is a side elevational view of the imprinter of FIG. 2 with the plunger mechanism thereof disposed in the loading position thereof.

Reference is had to FIG. 4 which illustrates the resetting of the hot leaf feed arrangement 14 at the point where the new hot leaf 24*a* has been guided about guide rollers 92*a*, 90*a* and 100*a* and has been guided about guide plate 106*a* and is about to be secured to plunger plate 184. For this purpose, as described above, plunger support plate 172, together with air cylinder 178 and plunger 182 may be pivoted in the clockwise direction about the axis defined by axle 174 as shown in FIG. 4 for more ready mounting of the beginning of the new hot leaf 24*a*. Stop member 200 on frame beam 12' serves to limit the pivoting in the counter clockwise direction of said plunger support plate when the plunger support plate is released and returned to its initial position by the action of torsion springs 176.

While take-up roll 26 is normally large enough to accept only slightly more than a single spool of hot leaf, the emptying of take-up roll 26 normally does not present a problem since the actual advance of the hot leaf can be accomplished by a pair of nip rollers in advance of take-up roll 26, said take-up roll being overdriven in coordination with the nip rollers to insure that the hot leaf is collected after passing between the nip rollers. In such an arrangement, the hot leaf leading to the full take-up roll 26 could be manually broken after the nip rollers, the take-up roll emptied and the broken end of the hot leaf threaded on the now empty take-up roll. In this manner, neither the printing station nor the associated equipment need be stopped.

Figure 14:
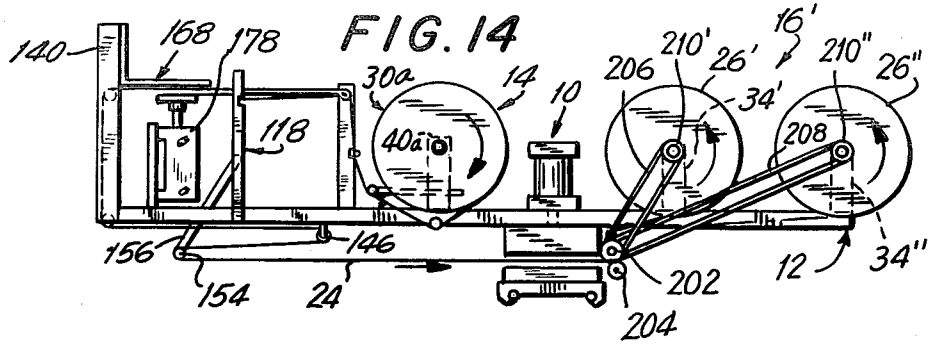
FIG. 14 is a partially schematic view of a second embodiment of the imprinter in accordance with the invention.

Referring now to FIG. 14, an alternate embodiment may be provided having a take-up roller arrangement 16' provided with a pair of take-up rolls 26' and 26'' mounted respectively on take-up roll supports 34' and 34'', in turn supported by main frame 12. After passing printing station 10, hot leaf 24 passes between nip rollers 202 and 204 which provide the affirmative drive for the hot leaf. Driven nip roller 202 is coupled to take-up roll 26' by belt 206 and to take-up roll 26'' by belt 208 so that the take-up rolls 26' and 26'' rotate coordinate with each other and with nip rollers 202 and 204. Belts 206 and 208 are coupled to take-up rolls 26' and 26'' respectively by clutches 210' and 210'' which permit the overdriving of take-up rolls 26' and 26'' and the stopping of one thereof to permit unloading. When take-up roll 26' is full, the operator merely cuts the hot leaf intermediate nip rollers 202 and 204 and take-up roll 26' and secures the cut end to take-up roll 26''. The operator can then, at his leisure, unload take-up roll 26'.

Referring now to FIG. 10, an alternate construction for the plunger in accordance with the invention is depicted. Specifically, plunger 182' is provided with a plunger plate 184' on which is secured a resilient plunger pad 186'. In place of spring clip 188, the top surface of plunger pad 186' is provided with an adhesive surface 210 for releasably receiving adhesive tape 192. The beginning of hot leaf 24*b* is secured to one-half of adhesive tape 192 by the adhesive 194 thereon. The adhesive 194 is preferably a stronger adhesive than the adhesive 210 so that when plunger 182' is displaced to engage adhesive tape 192 against hot leaf 24*a*, and thereafter retracted, the bond between the adhesive tape and the two hot leafs will remain secure but the lightly secured adhesive tape will be released.

Referring now to FIG. 11, still another embodiment of the plunger in accordance with the invention is provided. In this embodiment, plunger 182'' is provided with an access port 212 and plunger plate 184'' is formed with a chamber 214 in communication with port 212. Further, the upper surface of plunger 184'' and of plunger 186'' is provided with apertures 216 providing access to cavity 214. A vacuum pump would be applied to the entry to port 212 to create a force in the direction of arrows 216 which serves to hold adhesive tape 192 and the associated portion of hot leaf 24*b* in position on plunger plate 84'' until the adhesive tape is engaged against hot leaf 24*a* and retracted.

Figure 15:
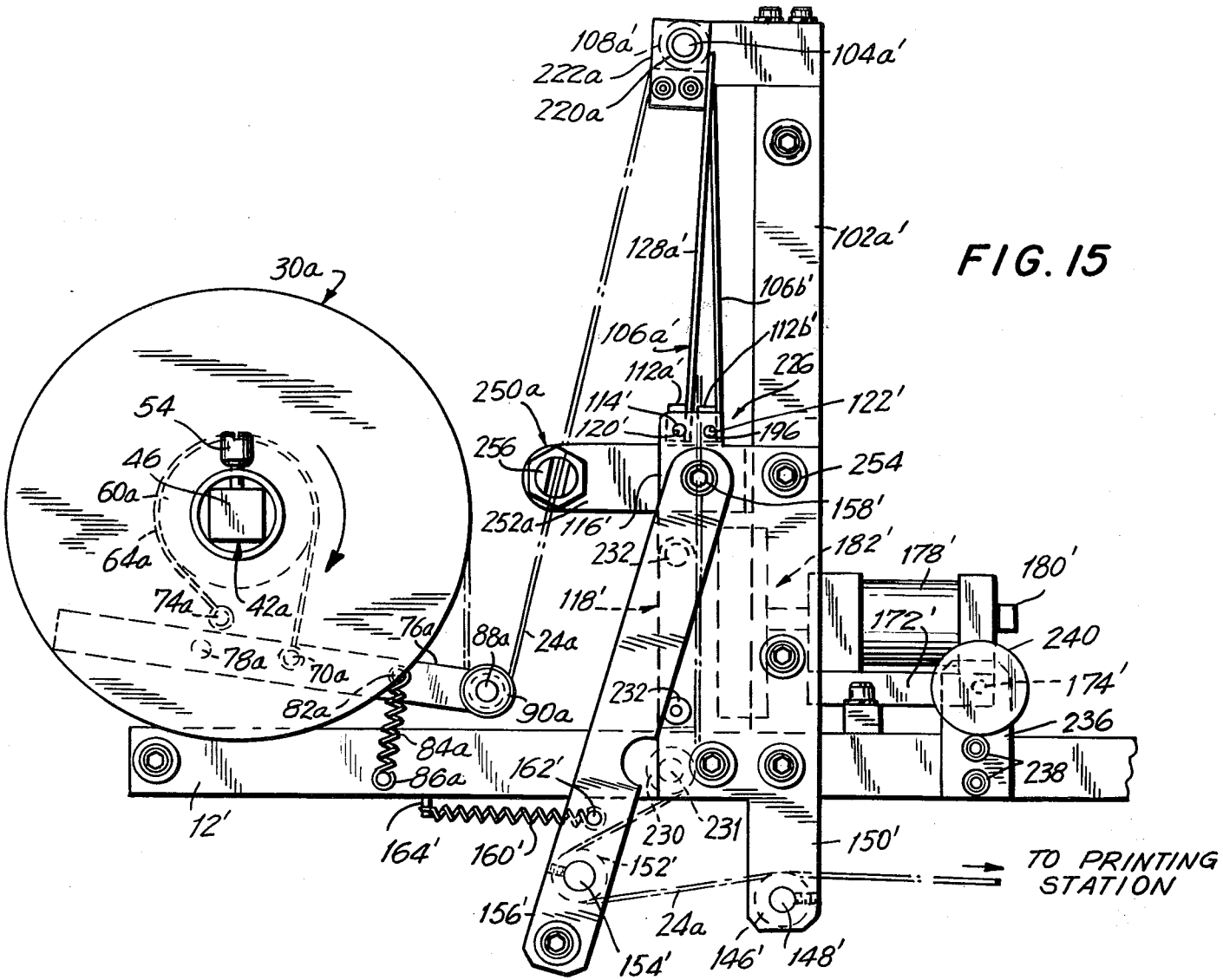
FIG. 15 is an enlarged fragmentary side elevational view of the hot leaf supply arrangement of a third embodiment of the imprinter in accordance with the invention.
Figure 16:
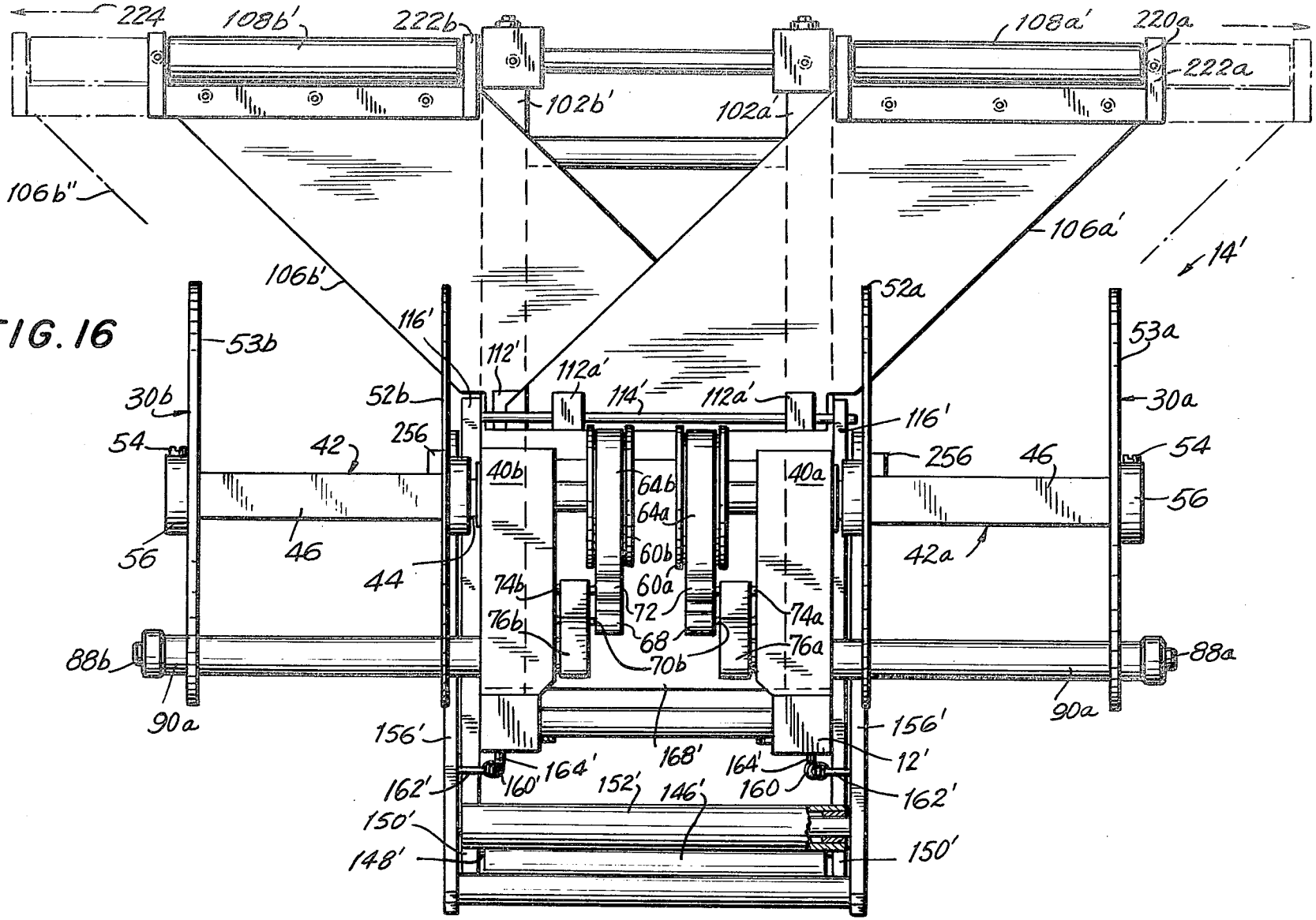
FIG. 16 is a left end elevational view of the embodiment of FIG. 15.
Figure 17:
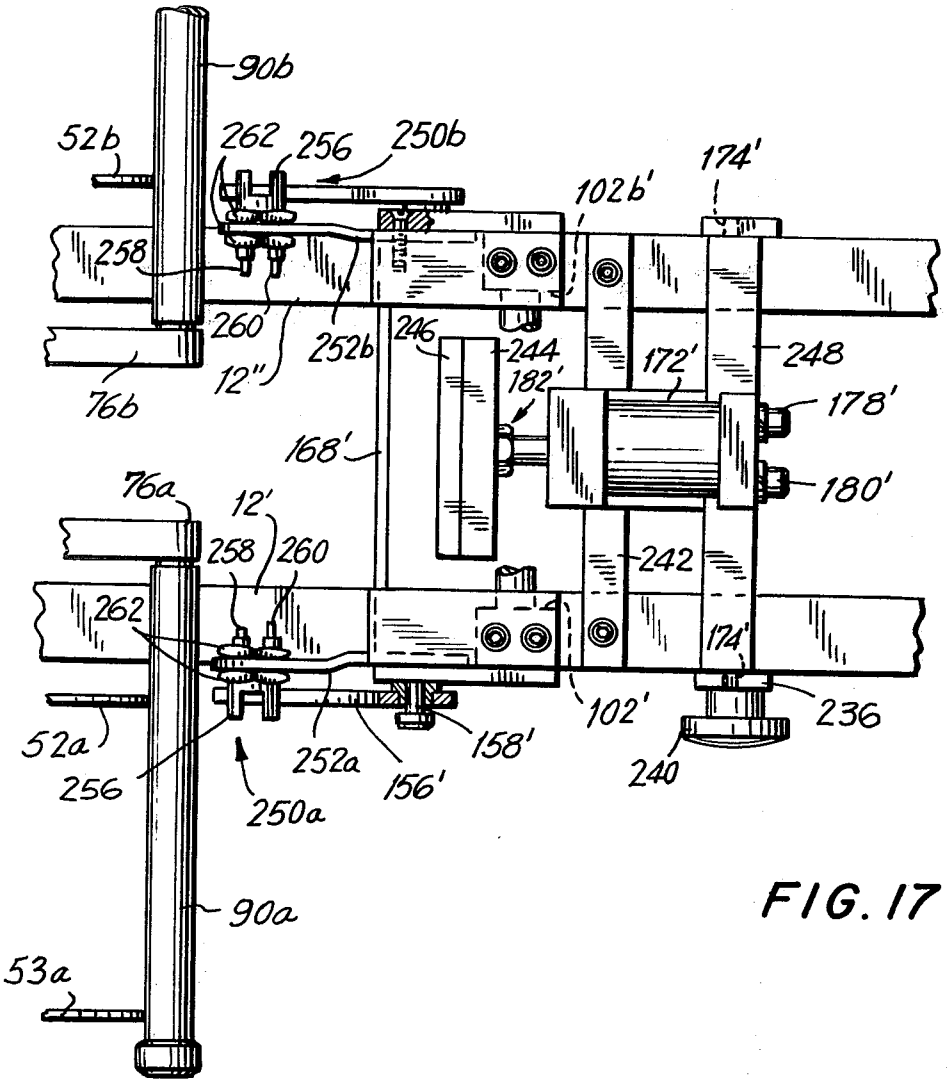
FIG. 17 is a top plan view of the embodiment of FIG. 15 with portions broken away including the guide plates and supports therefore.

Turning now to FIGS. 15, 16 and 17, a further embodiment of the hot leaf feed arrangement 14' is depicted, like reference numerals being applied to like elements. The embodiment of FIGS. 15–17 differs principally in the orientation of the elements to permit a more compact assembly, easier access to the plunger for loading and a more direct path for the hot leaf. Supply rolls 30*a* and 30*b* and the associated braking mechanism of the embodiment of FIGS. 15–17 is essentially identical to that depicted in connection with the embodiment of FIGS. 1–13 and further description thereof is not required. Hot leaf 24*a* (shown in phantom in FIG. 15) would extend about roller 90*a* which is mounted on pivot bar 76*b* to actuate the brake mechanism and to serve as a tensioning roller. From roller 90*a*, hot leaf 24*a* would extend upwardly as viewed in FIG. 15 and around a roller portion 108*a*' of a guide plate 106*a*'. Guide plate roller 108*a*' is rotatably mounted on a sleeve 220*a* supported on a guide plate bracket 222*a* which is secured to the central region 128*a*' of guide plate 106*a*'. Guide plate 106*a*' is mounted by means of sleeve 220*a* and guide plate bracket 222*a* on laterally extending post 104*a*', such mounting permitting both pivotable and lateral displacement of said guide plate relative to said post. A guide plate 106*b*' is similarly constructed and mounted on a corresponding post 104*b*

(not shown), the lateral displacement of guide plate 106b' in the direction of arrow 224 being illustrated in FIG. 16 by chain lines 106b''. Referring to FIG. 15, further guide plate support 118' is provided with a pair of side-by-side apertures 120' and 122'. The overlapped ends of guide plates 106a' and 106b' are held in position by rods 114' and 196' which rest in said apertures 120' and 196' respectively and engage and support said guide plates at tabs 112a' and 112b'. Guide plate 106a' may be pivoted in the clockwise direction as viewed in FIG. 15 about post 104a' after pin 114' is removed to permit lateral displacement thereof. Similarly, guide plate 106b' may be pivoted in the counter clockwise direction as viewed in FIG. 15 about the axis defined by post 104a' (but actually about post 104b' (not shown)), to a position in the gap 226 (FIG. 15) between support arm 116' and guide plate support 102a', posts 104a' and 104b' being supported by guide plate support 102a'.

The shape, function and operation of guide plates 106a' and 106b' are identical to that of guide plates 106a and 106b described above. Hot leaf 24a is guided around guide plate 106a' in the manner described above and continues downwardly past a back-up plate 168' (FIG. 17) to guide roller 230 rotatably mounted by axle 231 to frame beams 12' and 12''. Back-up plate 168' is mounted between guide plate supports 118' by means of screws 232. From guide roller 230, hot leaf 24a is guided around tensioning roller 152' mounted by axles 154' on arms 156', said arms being pivotably mounted on further guide plate support 118' by means of pins 158'. Tensioning roller 152' is tensioned by means of spring 160' secured by pin 164' at one end thereof to frame beam 12' and by pin 162' to one of arms 156'. From tensioning roll 152', hot leaf 24a extends over guide roll 146' which is mounted by means of axle 148' on tabs 150' depending from further guide plate support bracket 118'. From guide roller 146', the hot leaf is guided to printing station 10. A plunger support plate 172' is pivotably mounted by means of axle 174' on a pair of plunger brackets 236 secured respectively to frame beams 12' and 12'' by bolts 238. A knob 240 is secured to axle 174' for the manual pivoting of the plunger support plate 172 and cylinder 178' and plunger 182' supported thereby. Plunger support plate 172' normally rests on a stop bar 242. When so positioned, plunger plate 244 and plunger pad 246 may be displaced to effect the splicing of the beginning of one hot leaf roll to the end region of another. As best seen in FIG. 17, plunger plate 172' is pivotably mounted on axle 174' by means of a laterally extending support member 248. Also as shown in FIG. 17, cylinder 172' may be controlled through control ports 178' and 180'.

As more particularly shown in FIGS. 15 and 17, in this embodiment, a detector 250a and 250b are mounted in the path of each hot leaf intermediate guide rollers 90a and 90b on the one hand and roller portions 108a' and 108b' of guide plates 106a' and 106b' respectively. Said detectors are mounted on brackets 252a and 252 respectively, said brackets being secured to further guide plate supports 118' by bolts 254. In the embodiment depicted, each detector consists of a U-shaped detector element 256 through which an edge of the corresponding hot leaf passes. One arm of said detector could include a photo cell and the other arm could include a semiconductor light source, so that the passage of the end of a hot leaf roll therepast is detected by a signal applied along leads 258 (FIG. 17), the light source being energized along lines 260 (FIG. 17). Detector 256 is held on the associated bracket 252a or 252b by means of nuts 262. The signal from detector 256 would be passed to a control device (not shown) which coordinately operates cylinder 172' and cylinder 20 of printing station 10 in coordination with the operation of the wrapping or other associated equipment so that the actuation of plunger 172 occurs during the period that the hot leaf is not being advanced, and the hot leaf is advanced during the period that imprinting is not being effecte.

While cylinders 172 and 172' are shown as air cylinders, any form of pneumatic, hydraulic or electrical control may be utilized. Similarly, pneumatic, hydraulic or electrical controls can be used for cylinder 20.

Guide plates 106a and 106b are preferably coated with a friction reducing surfacing material such as Teflon.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improvement in hot leaf imprinters incorporating a printing station, the improvement comprising means for supporting first and second hot leaf supply rolls; guide means defining first and second guide paths respectively between said first and second supply roll supporting means and said printing station, said guide means being adapted so that the respective portions of said first and second paths adjacent said printing station correspond with each other and so that the portions of said first and second paths adjacent said corresponding portions are in spaced alignment so that hot leafs therein would be in spaced facing relation, said guide means being further adapted so that each of said guide paths includes a portion intermediate said supply roll support means and the aligned portions of said guide paths wherein the respective guide paths are in substantially side-by-side alignment so that the hot leaf therein are out of overlapping relation and a coupling portion between each of said side-by-side portions and the associated aligned portion, said guide means including first and second guide plate means defining said coupling portion of said guide means, each of such guide plate means including a central portion having first and second surfaces defined by first and second guide edges and front and rear edges bridging such first and second side edges, said first and second side edges of each guide plate means each extending at an angle to the associated front and rear edges, so that said associated front and rear edges are out of facing alignment with each other, the respective front edges of said guide plate means being in substantial spaced facing alignment to define a beginning region of said aligned portions of said guide paths, whereby hot leaf from each supply roll is guided past the rear edge of the associated guide plate means across a portion of the first surface, about the first side edge and across a portion of the second surface, about the second side edge and across a further portion of the first surface, and past the front edge; means for holding the beginning of a roll of hot leaf in the aligned portion of one of said paths; and means for selectively displacing said retained beginning of a hot leaf roll into secured relation with the facing portion of the hot leaf of the other roll, whereby said two hot leaf rolls may be spliced together in response to the actuation of said selective displacing means.

2. The imprinter as recited in claim 1, wherein said selective displacing means includes plunger means supporting said holding means for displacement therewith, said holding means being adapted to release said beginning of a roll of hot leaf after displacement thereof into secured relation with the facing portion of the hot leaf of the other roll.

3. The imprinter as recited in claim 2, including adhesive tape means secured to said beginning of a hot leaf roll with a portion of the adhesive thereof exposed and supported on said holding means so that the exposed adhesive is engaged against the facing portion of the hot leaf of the other roll to effect securing of the hot leaf of said rolls.

4. The imprinter as recited in claim 3, including backup plate means for supporting the hot leaf of said other roll during said securing displacement.

5. The imprinter as recited in claim 3, including means for pivotably mounting said plunger means between a operative position at which said securing displacement is effected and a mounting position at which said beginning of said hot leaf roll may be releasably secured to said holding means.

6. The imprinter as recited in claim 3, wherein said holding means includes a holding plate and clip means for releasably engaging the side periphery of said beginning of said hot leaf roll.

7. The imprinter as recited in claim 3, wherein said holding means includes light adhesive means for releasably retaining said beginning of said hot leaf roll.

8. The imprinter as recited in claim 3, wherein said holding means includes a plunger plate for supporting said beginning of said hot leaf roll, said plunger plate being formed with apertures in the surface thereof and a cavity therein communicating with said apertures and means for applying a vacuum to said cavity for releasably holding said beginning of said hot leaf roll.

9. The imprinter as recited in claim 1, including means for detecting the end of the hot leaf of said other roll and actuating said displacing means in response to such detection for effecting the splicing of the beginning of said one roll to substantially the end of said other roll.

10. The imprinter as recited in claim 1, wherein said guide means includes means for releasably supporting said guide plate means so as to permit the pivotable and lateral displacement thereof, whereby the front edges thereof in spaced facing relation and defining a part of the aligned portions of said paths may be displaced so that the relative positions thereof may be selectively switched.

11. The imprinter as recited in claim 10, wherein said releasable supporting means for said guide plate means includes frame means, including a central region, a laterally outwardly projecting pin member on each side of said central region for the respective pivotable and laterally displaceable support of one of said first and second guide plate means in the region of the rear edge thereof, said frame means further including first and second spaced releaseable support means in position to be in registration with the region of respective front edges of the said guide plate means, whereby after splicing, the guide plate means which had guided the hot leaf to which the beginning of a hot leaf roll was spliced may have its front edge released from said first releasable securing means to permit lateral displacement to a position out of registration with the other of said guide plate means, thereby permitting pivotable displacement of the front edge of the other of said guide plate means from the second to the first releasable securing means, and displacement and pivoting of the first-mentioned guide plate means to a position with the front edge thereof releasably secured by said second releasable securing means, so that said first-mentioned guide plate means may guide hot leaf to said holding means for the next splice.

12. A splicing apparatus for splicing rolls of tape material comprising means for supporting first and second supply rolls of said tape material; guide means defining first and second guide paths respectively between said first and second supply roll supports and an outlet of said splicing apparatus; said guide means being means adapted so that the respective portions of said first and second paths adjacent said outlet correspond with each other and so that the portions of said first and second paths adjacent said corresponding portions are in spaced alignment so that tape material therein would be in spaced facing relation; said guide means being further adapted so that each of said guide paths includes a portion intermediate said supply roll support means and the aligned portions of said guide paths wherein the respective guide paths are in substantially side-by-side alignment so that the tape material therein are out of overlapping relation and a coupling portion between each of said side-by-side portions and the associated aligned portion, said guide means including first and second guide plate means defining said coupling portion of said guide means, each of such guide plate means including a central portion having first and second surfaces defined by first and second guide edges and front and rear edges bridging such first and second side edges, said first and second side edges of each guide plate means each extending at an angle to the associated front and rear edges, so that said associated front and rear edges are out of facing alignment with each other, the respective front edges of said guide plate means being in substantial spaced facing alignment to define a beginning region of said aligned portions of said guide paths, whereby tape material from each supply roll is guided past the rear edge of the associated guide plate means across a portion of the first surface, about the first side edge and across a portion of the second surface, about the second side edge and across a further portion of the first surface, and past the front edge; means for holding the beginning of a roll of said tape material in the aligned portion of one of said paths and means for selectively displacing said retained beginning of said tape material roll into secured relation with the facing portion of the tape material of the other roll, whereby the beginning of one roll of said tape material may be spliced to another roll of said tape material.

13. The apparatus as recited in claim 12, including means for detecting the end of the tape material of said other roll and actuating said displacing means in response to such detection for effecting such splicing.

14. The apparatus as recited in claim 12, wherein said guide means includes means for releasably supporting said guide plate means so as to permit the pivotable and lateral displacement thereof, whereby the front edges thereof in spaced facing relation and defining a part of the aligned portions of said paths may be displaced so that the relative positions thereof may be selectively switched.

15. The apparatus as recited in claim 14, wherein said releasable supporting means for said guide plate means includes frame means, including a central region, a laterally outwardly projecting pin member on each side of said central region for the respective pivotable and laterally displaceable support of one of said first and second guide plate means in the region of the rear edge thereof, said frame means further including first and second spaced releasable support means in position to be in registration with the region of respective front edges of the said guide plate means, whereby after splicing, the guide plate means which had guided the tape material to which the beginning of a tape material roll was spliced may have its front edge released from said first releasable securing means to permit lateral displacement to a position out of registration with the other of said guide plate means, thereby permitting pivotable displacement of the front edge of the other of said guide plate means from the second to the frist releasable securing means, and displacement and pivoting of the first-mentioned guide plate means to a position with the front edge thereof releasably secured by said second releasable securing means, so that said first-mentioned guide plate means may guide tape material to said holding means for the next splice.

* * * * *